United States Patent [19]

Fuselier

[11] 4,037,051

[45] July 19, 1977

[54] FLAT BAFFLE SPEAKER SYSTEM HAVING IMPROVED CROSSOVER

[76] Inventor: John A. Fuselier, 4309 Oak Walk N., Cumming, Ga. 30130

[21] Appl. No.: 652,289

[22] Filed: Jan. 26, 1976

[51] Int. Cl.[2] ..... H04R 1/22

[52] U.S. Cl. ..... 179/1 E

[58] Field of Search ..... 179/1 E

*Primary Examiner*—George G. Stellar

*Attorney, Agent, or Firm*—Robert B. Kennedy

[57] ABSTRACT

Method and apparatus for balancing frequency crossover of an audio speaker system is disclosed by which a system woofer circuit is provided with inductance proportional to the product of woofer impedance and the effective baffle diameter of a flat baffle to which a system squaker is mounted.

11 Claims, 4 Drawing Figures

FLAT BAFFLE SPEAKER SYSTEM HAVING IMPROVED CROSSOVER

BACKGROUND OF THE INVENTION

This invention relates generally to audio speaker systems, and particularly to audio speaker systems of the type which include one or more middle frequency range drivers or squakers mounted on a flat baffle, and one or more low frequency range drivers or woofers.

Audio speaker systems today frequently employ a plurality of speakers or drivers individually constructed for response to diverse audio frequency ranges. Such a system may, for example, employ a low-range driver or woofer, a mid-range driver or squaker which sometimes is referred to as a mid-range tweeter, and a high-range driver or tweeter. The upper end portion of the frequency response range of the woofer is selected to overlap the lower end portion of the squaker in order to achieve sufficient response throughout their combined ranges. Similarly, the upper end portion of the squaker range is selected to overlap the lower portion of the tweeter range. Within these overlapping or crossover frequency ranges response dropoff of each speaker must be so controlled as to produce substantially level response in the aggregate. Otherwise, at crossover frequencies the system would produce an output volume differing, usually to excess, from that of the other frequencies.

To shape the frequency response curves of the various system drivers electronic circuits have heretofore been devised generally referred to as crossover networks. Exemplary of such networks are those disclosed in U.S. Pat. Nos. 2,612,558, 2,832,828, 3,457,370, 3,383,215 and 3,895,193.These circuits have comprised a number of electronic components connected in circuit with the audio signal circuit that couples the drivers with the signal output ampifiers. Typically, these networks have included one or more inductors in series circuit with one or more drivers, and one or more capacitors in parallel therewith. For example, with an inductor placed in series with a woofer the acoustic output of the woofer can be made to provide an energy output level of −3 db at nominal crossover frequencies with a filter slope of 6 db per octave. With a capacitor placed in series circuit with the system squaker an energy level of −3 db can also be achieved at that frequency with a filter slope of 6 db per octave. The provision of series resonant circuits in the network can insure smooth circuit impedance throughout crossover. Such impedance correction networks are usually required to compensate for variations between designed and actual load impedances of the driver for which the frequency balancing network is itself designed.

The combination of the just described networks is cumulatively productive of fairly complex and expensive circuitry. That audio frequency and wavelength are axiomatically related has heretofore led others to seek mechanical means, usually involving the spacing of speakers or dimensioning of audio transmission lines therebetween to harmonize multiple drivers in a single system. These approaches however, as evidenced by U.S. Pat. Nos. 3,155,774, 3,165,587 and 3,727,004, have not completely eliminated the need for crossover networks. In audio systems having a woofer and a flat baffle squaker from both sides of which soundwaves are propagated substantially unbaffled, a mechanical approach towards eliminating or simplifying crossover networks have been apparently unfeasible. The present invention nevertheless is directed to just such a development.

Accordingly, general objects of the invention are to provide improved audio speaker systems and methods for balancing frequency crossover between system component speakers.

More specifically, it is an object of the invention to provide an improved method of balancing frequency crossover of an audio speaker system having a flat baffle mid-range speaker and a low-range speaker.

Another object of the invention is to provide a method of dimensioning a flat baffle supporting a mid-range speaker for audio system use with a low-range speaker.

Another object of the present invention is to provide an improved audio speaker system of the type having a mid-range speaker mounted on a flat baffle and a low-range speaker.

Another object of the invention is to provide an audio speaker system of the type just described with improved, relatively simple and economic frequency crossover balancing means.

Yet another object of the invention is to provide an audio speaker system of the type described which exhibits minimal phase shift between speakers.

SUMMARY OF THE INVENTION

In one form of the invention a method is provided for balancing frequency crossover of an audio speaker system having a flat baffle mid-range speaker and a low-range speaker. The method comprises the steps of determining the effective baffle diameter of the flat baffle mid-range speaker, determining the impedance of the low-range speaker, and providing the low-range speaker with series circuit inductance proportional to the product of the determined mid-range speaker effective baffle diameter and the low-range speaker impedance.

In another form of the invention a method is provided for dimensioning a flat baffle adapted to support a squaker for use with a woofer in an audio speaker system. The method comprises the steps of determining the impedance and inductance of the woofer and providing the flat baffle with an effective baffle diameter of the product of the determined woofer inductance times $2\pi S$ where S is the speed of sound ambient the audio speaker system divided by between approximately 2 and 3 times the determined woofer impedance.

In yet another form of the invention an audio speaker system is provided comprising a squaker mounted on a flat baffle having an effective baffle diameter and a woofer having woofer impedance and woofer circuit inductance proportional to the product of the woofer impedance and the effective baffle diameter. Preferably, the woofer inductance is between 2 and 3 times the product of the effective baffle diameter and the woofer impedance times the inverse of $2\pi S$ where S is the speed of sound ambient the system.

DETAILED DESCRIPTION OF THE PREFERRED EMBODIMENTS

Figure 1:
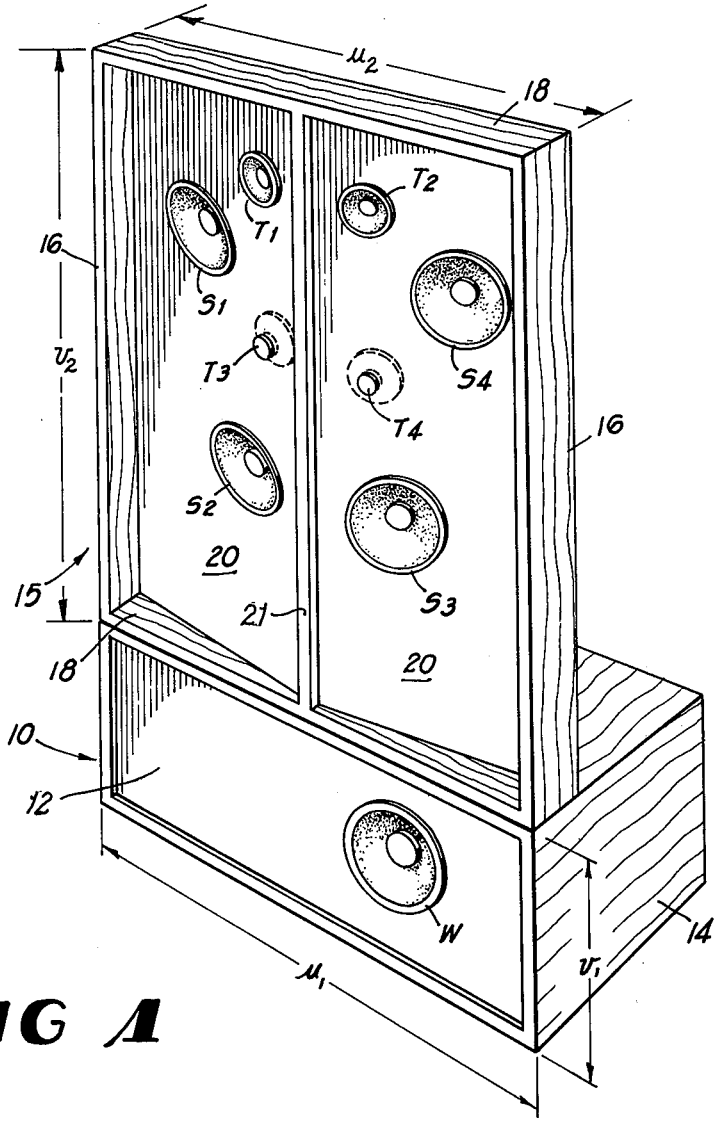
FIG. 1 is a perspective view of an audio speaker system embodying principles of the invention in one preferred form.

Referring now in more detail to the drawing, there is shown in FIG. 1 an audio speaker system comprising a woofer W mounted asymmetrically on a front, rectangular panel 12 of an enclosed woofer cabinet 10. The width $u_1$ of the woofer cabinet here is 26.5 inches while the height $v_1$ is 12 inches. The cabinet side panels 14 extend right-angularly from the front panel and are each 12 inches square.

Atop the woofer cabinet adjacent its front edge is mounted a flat baffle 15 having side frame members 16 of 32 inch heights $v_2$, and top and bottom frame members 18 of 26½ inch lengths $u_2$. Two baffle panels 20 are mounted within the baffle frame canted at a slight rearward angle from a center frame member 21. Four squakers $S_1$, $S_2$, $S_3$, and $S_4$ are mounted asymmetrically on the baffle panels with both sides of their cones exposed to ambient air. Four tweeters $T_1$, $T_2$, $T_3$, and $T_4$ are also asymmetrically mounted on these panels with tweeters $T_1$ and $T_2$ oriented for front firing and tweeters $T_3$ and $T_4$ oriented for rear firing. Tweeters $T_3$ and $T_4$ are electrically connected out of phase with $T_1$ and $T_2$, i.e. with reverse polarity.

Figure 2:
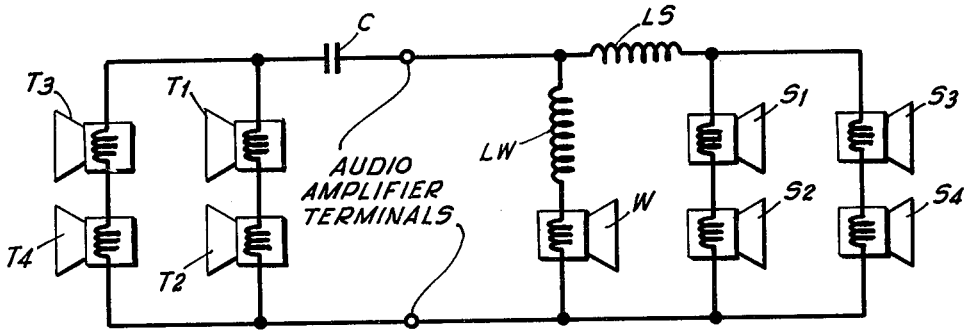
FIG. 2 is a circuit diagram of electronic circuitry of the audio speaker system illustrated in FIG. 1.

The just described speaker system is coupled with unshown audio signal generation and amplification means by the electronic circuitry illustrated in FIG. 2. Woofer W is seen to be coupled across the audio amplifier output terminals through an inductor L*w*. Squakers $S_1$ and $S_2$ are coupled in series circuit across the amplifier through an inductor L*s*. Squakers $S_3$ and $S_4$ are similarly coupled in series circuit across the amplifier through inductor L*s* in parallel with squakers $S_1$ and $S_2$. The tweeters $T_1$ and $T_2$ are connected in series circuit with each other and with a capacitor C across the amplifier while tweeters $T_3$ and $T_4$ are also connected in series across the amplifier through the same capacitor. Capacitor C is conventionally provided to protect the tweeter from low frequency input signals while inductor L*s* is provided to filter high frequencies from the squakers.

It will be noted that the only other discrete electronic element in the circuitry shown here is the inductor L*w* and that there is no conventional crossover network or series resonant circuit presetn to filter low frequencies from the squakers. The provision of the particluar inductance provided by inductor L*w* has, in combination with the dimensioning of the flat baffle, eliminated such. As previously stated, the magnitude of this inductance is proportional to the product of effective baffle diameter of the flat baffle and impedance of the woofer. The term "effective baffle diameter" usually means, in the case of circular baffles, the diameter of the circle. With square baffles it is ordinarily meant to denote the length of a side. For other rectangular baffles it usually means the average length of the sides until a 3:5 ratio, after which the effective baffle diameter does not increase. Realizing that the peripheries of baffles may take many other shapes, for the purpose of this application the term is intended to mean twice the average distance from the geometric center of the baffle to the baffle periphery. An exception, however, does exist where the baffle is coupled to an adjacent, extraneous surface such as a supporting floor or wall in which case the effective baffle diameter is double that just defined for square flat baffles and for other rectangular baffles having a shorter side perpendicular the adjacent surface. For rectangular baffles having a longer side perpendicular the adjacent surface the effective baffle diameter is increased by a factor of 2 times the shorter side dimension over the longer side dimension with the limitation that the factor be not less than 1. When the flat baffle is coupled to two adjacent surfaces, as with a supporting floor and an adjacent wall, the effective baffle diameter is increased by a factor of $2 + \sqrt{2}$ (shorter side length/longer side length). For the purpose of this application the term woofer inductance is intended to mean the inductance in the circuit by which audio signals are transmitted to the woofer from an audio amplifier as opposed, necessarily, only to the inductance of the woofer itself.

As previously stated, Applicant has discovered that if inductance added in the woofer circuit falls within a certain range with relation to a given effective baffle diameter for the squaker, crossover circuitry can be eliminated. Specifically, Applicant has discovered that inductance in henries, in the range of approximately 2 to 3 times kDI, itself effectively balances crossover where D is the effective baffle diameter in feet, I is woofer impedance in ohms, and $k$ is $\frac{1}{2}\pi S$ where S is the speed of sound in the air ambient the speaker system. Within this range 2.56 has been found to be optimum with the small inductance of the voice coil of the woofer itself discounted. Multiplication and location of speakers has not been found to have a substantial bearing on this although the ratio of minimum to maximum air distances between opposite sides of each squaker cone obtained through asymmetric mountings should be in a ratio of at least 3:5.

Using the just described formula, the value of L*w* for the system of FIGS. 1 and 2 may be calculated as follows:

$$Lw = \frac{(2.56)\,(8)\left(\frac{2.21 + 2.21 + 2.67 + 2.67}{4}\right)(2)\left(\frac{2.21}{2.67}\right)}{(2)\,(\pi)\,(1140)} = .01155 \text{ henries}$$

wherein 8 is the impedance of the woofer W in ohms at crossover frequency and 2 is included in the numerator since the flat baffle is coupled with the floor. Were it suspended in air this factor would not appear. Conversely, given L*w* of 11:55 millihenries the effective baffle diameter of 9.76/4 feet can be calculated for baffle dimensioning with accompanying balancing benefits. Crossover frequency itself here was determined by:

$$fc = \frac{1140}{(2.56)\,\frac{2.21 + 2.21 + 2.67 + 2.67}{4}\,(2)\,\frac{2.21}{2.67}} = 110.28 \text{ Hz}$$

Figure 3:
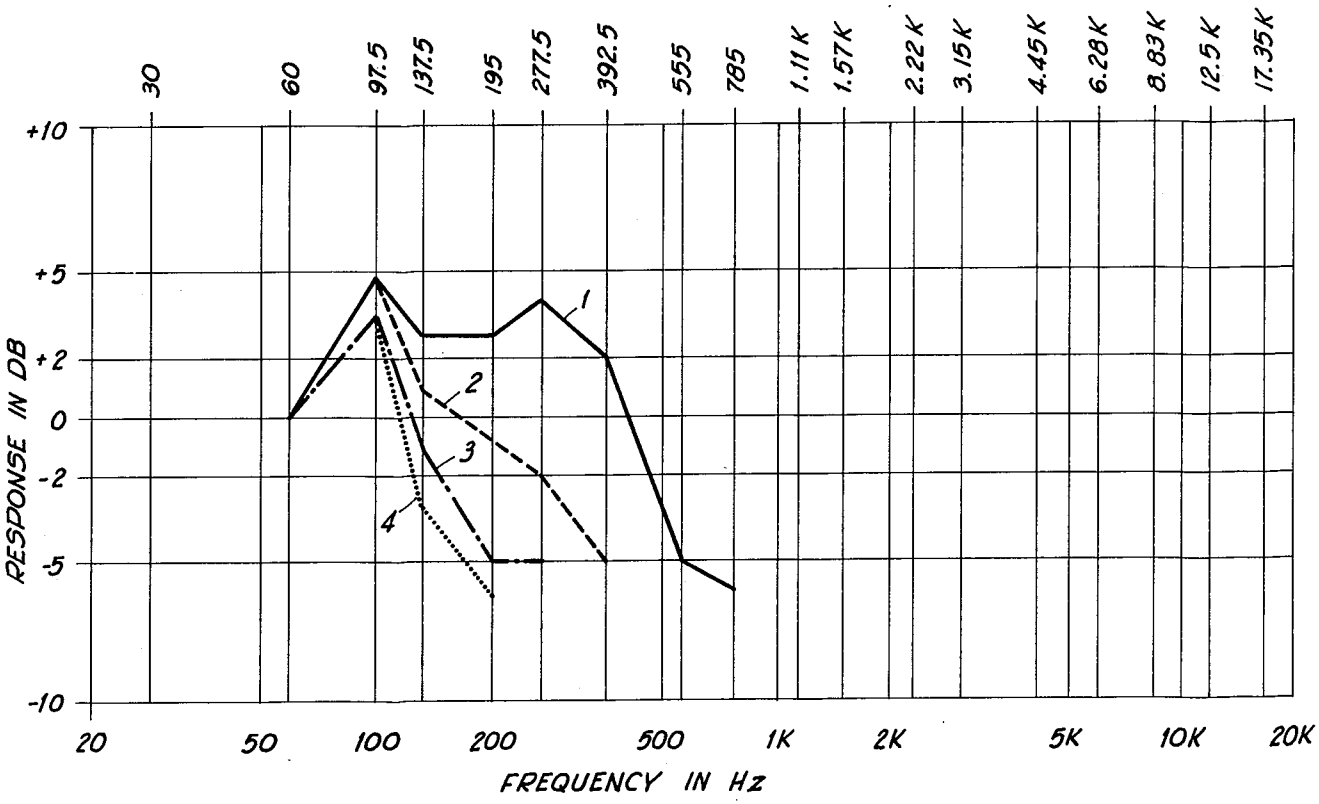
FIG. 3 is an audio response graph of the woofer component of the audio speaker system shown in FIG. 1.
Figure 4:
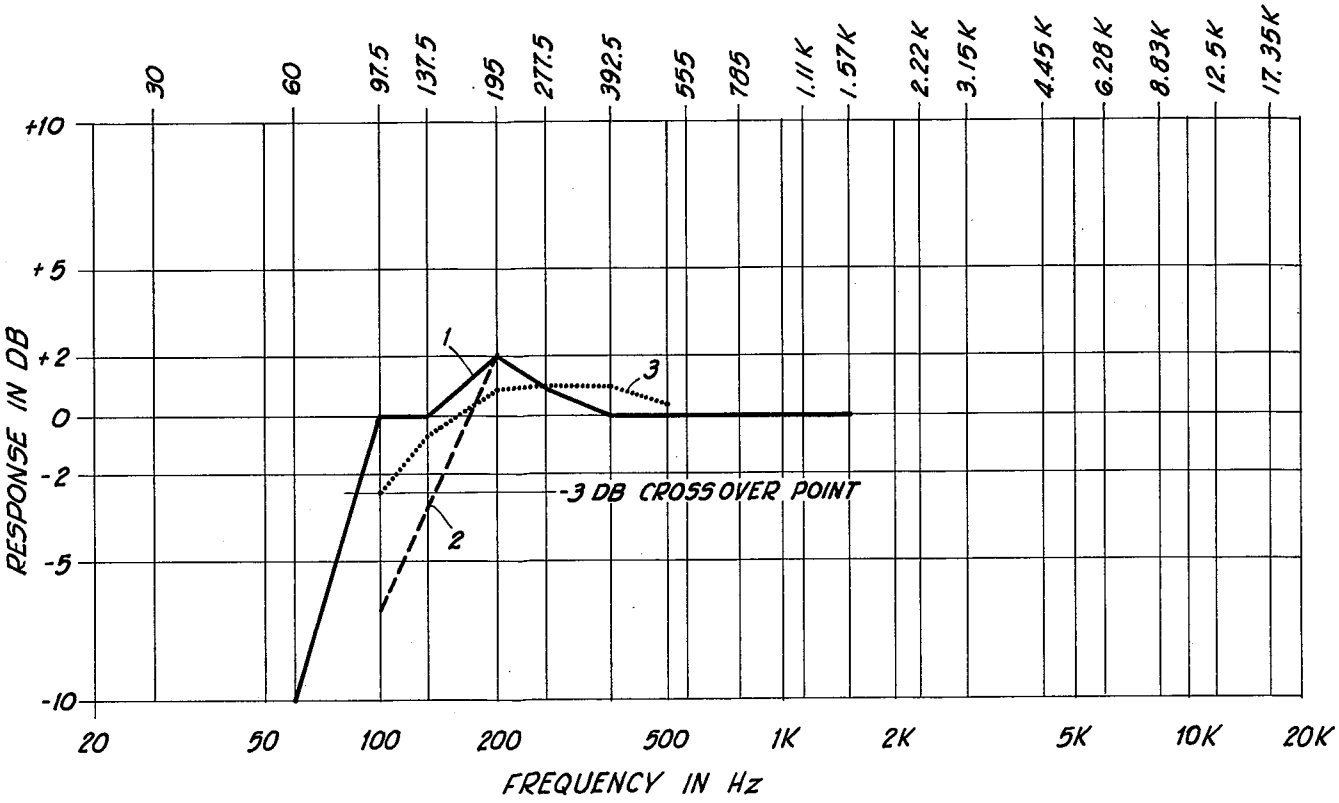
FIG. 4 is an audio response graph of the squaker and tweeter component of the audio speaker system shown in FIG. 1.

Response curves of the speaker system of FIGS. 1 and 2 appear in FIGS. 3 and 4. These curves are derived from empherical measurements obtained from indoor system operations with the woofer box placed directly upon a supporting floor and the flat baffle also coupled with the floor. Frequency here is measured at half octave band centers of warble tones in Hz while response is measured in db. In FIG. 3 Curve 1 was obtained for the woofer alone with L*w* = 0, Curve 2 with L*w* = 6.4mh, Curve 3 with L*w* = 11.55 mh and Curve 4 with $Lw = 19$ mh. In FIG. 4 Curve 1 was obtained with the squakers and tweeters alone and with the baffle extended dimensionally to 5 feet square, Curve 2 for the baffle with the dimensions previously defined, and Curve 3 with the baffle set directly upon the floor. It will be noted that Curve 3 of FIG. 3 and Curve 2 of FIG. 4 cross approximately at the $-3$ db response level.

In view of the foregoing it is apparent that Applicant has discovered a new and simple method of balancing frequency response of audio speaker systems by which a system low-range driver is provided with circuit inductance proportional to the product of the driver impedance and the effective baffle diameter of a system mid-range driver mounted on a flat baffle. Conversely, the flat baffle may be dimensioned from given woofer impedance and circuit inductance.

What is claimed is:

1. The method of balancing frequency crossover of an audio speaker system having a flat baffle squaker and a woofer, said method comprising the steps of a. determining the effective baffle diameter of the flat baffle squaker;

b. determining the impedance of the woofer; and c. providing the woofer with series circuit inductance proportional to the product of the determined effective baffle diameter and woofer impedance.

2. The method of balancing frequency crossover in accordance with claim 1 wherein step (b) the impedance of the woofer is determined at system crossover frequency.

3. The method of balancing frequency crossover in accordance with claim 2 wherein step (c) the woofer is provided with circuit inductance in henries approximating $2\frac{1}{2}$ times the product of effective baffle diameter in feet and woofer impedance in ohms divided by the product of $2\pi$times the speed of sound in feet per second ambient the system.

4. In an audio speaker system having a middle frequency range driver mounted on a flat baffle of selected effective baffle diameter in feet and a low frequency range driver of selected impedance in ohms coupled by electric circuitry with an audio signal source, the improvement comprising said electric circuitry having inductance in henries of between two and three times the product of said effective baffle diameter and said low frequency range driver impedance times the inverse of $2\pi s$ where $s$ is the speed of sound ambient the system in feet per second.

5. In balancing frequency crossover of an audio speaker system having a flat baffle mounted middle frequency range driver and a low frequency driver, the improvement comprising providing the low frequency driver with circuit inductance of a magnitude in henries substantially in accordance with the formula $L = kDI$ where L is the low frequency driver circuit inductance in henries, $k$ is constant within the range of two to three times the inverse of $2\pi s$ where $s$ is the speed of sound ambient the speaker system in feet per second, D is effective baffle diameter in feet of the flat baffle upon which the middle frequency range driver is mounted, and I impedance in ohms of the low frequency range driver.

6. The improvement in balancing frequency crossover of claim 5 wherein $k$ is substantially 2.56.

7. In an audio speaker system having at least one squaker mounted on a flat baffle and at least one woofer of selected impedance in ohms and woofer circuit inductance in henries, the improvement comprising said flat baffle having an effective baffle diameter in feet of between $\frac{1}{2}$ and $\frac{1}{3}$ $kL/I$ where I is the woofer impedance in ohms, L is the woofer circuit inductance in henries and $k$ is $2\pi s$ where $s$ is the speed of sound in the air about the audio speaker system in feet per second.

8. The improvement in audio speaker systems of claim 7 wherein I is the woofer circuit impedance substantially at crossover frequency of the woofer and squaker.

9. In an audio speaker system, the method of dimensioning a flat baffle adapted to support a squaker for use with a woofer, said method comprising the steps of determining the impedance and inductance of the woofer and providing the flat baffle with an effective baffle diameter of the product of the determined woofer inductance times $2\pi s$ where $s$ is the speed of sound ambient the audio speaker system divided by between approximately two and three times the determined woofer impedance.

10. The dimensioning method of claim 9 wherein the impedance of the woofer is determined substantially at crossover frequency of the woofer and squaker.

11. The dimensioning method of claim 9 wherein the flat baffle is provided with an effective baffle diameter of approximately $(2\pi sL)/(2.56I)$ where I is the impedance of the woofer and L is the inductance of the woofer.

* * * * *